United States Patent [19]

Vanderpool

[11] 4,385,972

[45] May 31, 1983

[54] ELECTROLYTIC DISINTEGRATION OF SINTERED METAL CARBIDES

[75] Inventor: Clarence D. Vanderpool, Towanda, Pa.

[73] Assignee: GTE Products Corporation, Stamford, Conn.

[21] Appl. No.: 332,399

[22] Filed: Dec. 18, 1981

Related U.S. Application Data

[63] Continuation of Ser. No. 75,622, Sep. 14, 1979, abandoned.

[51] Int. Cl.[3] ..... C25F 5/00

[52] U.S. Cl. ..... 204/146

[58] Field of Search ..... 204/146

[56] References Cited

U.S. PATENT DOCUMENTS

| | | | |
|---|---|---|---|
| 2,872,394 | 2/1959 | Newman | 204/146 |
| 3,887,680 | 6/1975 | MacInnis | 423/55 |
| 4,128,463 | 12/1978 | Formanik | 204/146 |
| 4,140,597 | 2/1979 | Kobayakawa | 204/146 |
| 4,234,333 | 11/1980 | Ghandehari | 204/146 |

OTHER PUBLICATIONS

Indian J. of Tech., vol 4, Oct. 1966, pp. 313–314.

*Primary Examiner*—T. M. Tufariello
*Attorney, Agent, or Firm*—R. E. Walter

[57] ABSTRACT

Tungsten and cobalt metal are recovered from cemented carbides by the electrolytic disintegration of the cemented carbide as the anode in an aqueous electrolyte containing a soluble alkali metal hydroxide. Tungsten carbide is thus converted to carbide particles, which precipitate from the electrolytic solution. The cobalt metal is precipitated in the electrolyte or plated on the cathode. The cobalt metal is then recovered by separation of a cobalt salt, followed by thermal reduction of the salt.

4 Claims, 1 Drawing Figure

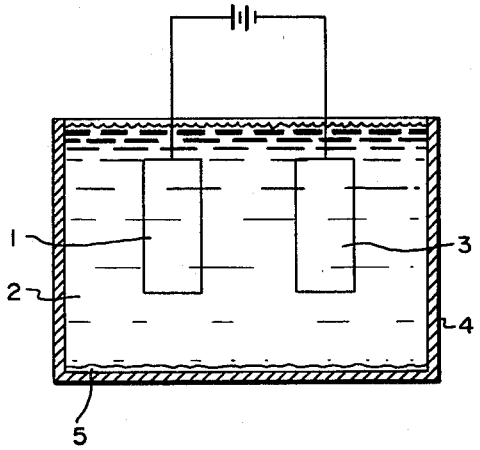
1
2
3
4
5

ELECTROLYTIC DISINTEGRATION OF SINTERED METAL CARBIDES

CROSS REFERENCE TO RELATED APPLICATIONS

This is a continuation of application Ser. No. 075,622, filed Sept. 14, 1979 now abandoned.

TECHNICAL FIELD

This invention relates to the recovery of metals from sintered metal carbides, and more particularly relates to the electrolytic dissolution of sintered metal carbides in the presence of alkali hydroxides to separate and recover one or more metallic components therefrom.

BACKGROUND ART

Sintered metal carbides, including cemented carbides in which carbide particles such as tungsten carbide, titanium carbide, tantalum carbide or niobium carbide particles are cemented together with a binder metal such as cobalt, iron, nickel or an alloy of one or more of these elements, are widely used as cutting tools, drilling tools and wear parts.

Reclamation of the components from scrap has been a problem for the carbide industry since 1926 when Schroter first used "members of the iron group" (iron, nickel and cobalt) as binders for tungsten carbide. The members of this group wet the grains of tungsten carbide, making it very difficult to remove them from between the grains during reclaiming. However, because of the increasing prices of the component metals, notably tungsten and cobalt, it is becoming increasingly attractive economically to reclaim one or more of the components from these carbides.

Various processes are known to disintegrate the cemented carbide into a powder mixture which, with or without further processing, can then be recycled to make more carbide. Such processes have included alloying with zinc, acid leaching and fusion with nitrates.

In U.S. Pat. No. 3,595,484, the binder metal is dissolved in molten zinc to break the bond with the carbide, followed by distillation of the zinc to leave behind separated particles of carbide and binder metal, which can then be reprocessed.

Other disintegration methods are described in: U.S. Pat. No. 2,848,313 (increased internal stresses caused by the formation of a hydrated salt); U.S. Pat. No. 3,184,169 (pneumatic pulverizer); U.S. Pat. No. 3,438,730 (milling in the presence of phosphoric acid and free oxygen); and U.S. Pat. No. 3,635,674 (subjection to ammonia or ammine and free oxygen under pressure).

In U.S. Pat. No. 3,953,194, the cemented carbide is subjected to catastrophic oxidation, converting it to a friable, easily-crushed mass, crushed to powder, reduced to metal, and carburized to obtain a mixture of tungsten carbide and cobalt powders for reprocessing.

Other processes are available to separate the component metals or oxides after oxidation or reduction. For example, U.S. Pat. No. 2,704,240 calls for dissolving the cobalt values in an inorganic acid such as sulfuric or hydrochloric followed by recovery of the cobalt from solution. U.S. Pat. No. 3,887,680 calls for separation by digestion of the tungsten values in an alkali metal hydroxide in order to form an aqueous soluble alkali metal tungstate.

DISCLOSURE OF THE INVENTION

In accordance with the invention, it was discovered that sintered metal carbides such as cemented carbides, can be disintegrated by electrolysis in the presence of an alkali metal hydroxide, and recovered as carbide particles. Any binder metal present dissolves in the electrolyte and either is deposited on the surface of the cathode, or is precipitated as hydroxide, or elemental Co.

As used herein, the term "sintered metal carbide" means any sintered refractory metal carbide such as tungsten carbide, titanium carbide, tantalum carbide, or niobium carbide, either with or without a binder metal. "Cemented carbide" means sintered metal carbide particles cemented together by a binder, and "binder" means an iron group metal such as cobalt, iron, nickel or an alloy of one or more of these metals. The total amount of binder metal in the cemented carbides typically ranges from about 3 to 25 weight percent.

BRIEF DESCRIPTION OF THE DRAWING

The FIGURE is an electrolysis apparatus suitable for the practice of the invention described herein.

BEST MODE FOR CARRYING OUT THE INVENTION

For a better understanding of the present invention, together with other and further objects, advantages and capabilities thereof, reference is made to the following disclosure and appended claims in connection with the above-described drawing.

In the practice of the invention, the carbide to be processed is made the anode or positive pole of an electrolytic cell such as the one depicted in the FIGURE. The anode 1 is suspended in an aqueous electrolyte 2 containing in solution a soluble alkali metal hydroxide, such as sodium hydroxide, potassium hydroxide or lithium hydroxide. The presence of such agent retards the formation of metal oxides during electrolysis, permitting the recovery as carbides and thus allowing reprocessing without the necessity for intermediate reduction and carburization steps. The carbide particles settle to the bottom of the electrolysis vessel 4, from which they may be recovered, such as by decantation of electrolyte and/or filtering, followed by optional washing, and drying steps, if desired.

Any binder metal initially present in the carbide which is dissolved in the electrolyte by electrolysis may be subsequently recovered as a salt by evaporation of electrolyte, or addition of a precipitation agent. The salt may then be separated and thermally reduced to obtain metal powder.

EXAMPLE I

A piece of cemented tungsten carbide containing small amounts of titanium carbide and niobium carbide was attached to a tungsten wire and suspended in an electrolyte solution containing 10 grams of sodium hydroxide dissolved in 100 milliliters of deionized water. The tungsten carbide was connected to a dc power source as the positive pole or anode of the system and a stainless steel wire mesh was used as the negative pole or cathode. The conditions of the electrolysis reaction were as follows:

| Current | Potential | Electrolyte Temp. |
|---|---|---|
| 18 Amps | 7–8 volts | 90–100° C. |

After initiation of the electrolysis reaction, particles were observed to be separating from the carbide piece. After about 1 hour, the electrolysis reaction was stopped and the black particles were recovered by filtration and identified by X-ray diffractions as WC and TiC.

EXAMPLE II

A piece of WC was attached to a tungsten wire and suspended in an electrolyte solution containing 100 grams of sodium hydroxide in 1000 milliliters of deionized water. The WC was connected to a dc power source as the positive pole or anode of the system and platinum was used as the cathode. The conditions of the electrolysis reaction were as follows:

| Time | Volts | Amps | Results |
|---|---|---|---|
| 3:30 p.m. | 8.0 | 6.0 | Start |
| 3:38 | 8.0 | 11.0 | Solution turning blue |
| 4:15 | 8.0 | 11.5 | Solution turning black |
| 4:24 p.m. | 8.0 | 12.0 | Solution turning black |
| Following Day: | | | |
| 7:23 a.m. | 8.0 | 8.0 | Black precipitate formed |
| 8:32 | 8.0 | 11.0 | Stirred solution |
| 10:05 | 8.0 | 10.0 | |
| 12:35 p.m. | 8.0 | 8.0 | Water added to replace evaporated amount |
| 2:30 | 8.0 | 10.0 | Some Co plated on cathode |
| 4:00 | 8.0 | 9.0 | Stop |

X-ray diffraction of the solid particles recovered from the electrolysis vessel by filtering revealed WC with a trace of cobalt oxide.

EXAMPLE III

The procedure of Example I was repeated except that potassium hydroxide was used in place of sodium hydroxide. A 68 gram piece of cemented tungsten carbide was used as the anode and a platinum wire as the cathode. The conditions of the electrolysis reaction were as follows:

| Time | Volts | Amps | Results |
|---|---|---|---|
| 1:50 p.m. | 10.0 | 10.0 | Start |
| 1:55 | 10.0 | 10.0 | Solution turning dark |
| 2:07 | 10.0 | 10.0 | Added water to hold volume constant; Some solids setting |
| 2:31 | 10.0 | 9.0 | Some solids setting |
| 2:50 | 10.0 | 8.5 | Some solids setting |
| 3:06 | 10.0 | 8.5 | Some solids setting |
| 3:30 | 10.0 | 7.5 | Some solids setting |
| 3:50 | 10.0 | 7.5 | Stop |

X-ray diffraction of filtered solids showed tungsten carbide and FCC cobalt were recovered.

EXAMPLE IV

The procedure of Example I was repeated except that platinum foil was used as the cathode. The cemented tungsten carbide anode weighed about 22 grams. The conditions of the electrolysis reaction were as follows:

| Time | Volts | Amps | Results |
|---|---|---|---|
| 10:25 a.m. | 8.0 | 9.5 | Start |
| 10:29 | 8.0 | 10.5 | Solution turning dark |
| 10:32 | 8.0 | 12.0 | Black particles forming |
| 10:35 | 8.0 | 10.0 | |
| 10:44 | 8.0 | 7.0 | Repaired poor connection |
| 11:25 | 8.0 | 10.0 | |
| 12:25 | 8.0 | 11.5 | Stop |

The anode had lost 2.8 grams in weight.

The black particles were recovered by filtering and drying and analyzed by X-ray diffraction to be tungsten carbide and FCC cobalt together with some amorphous material.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention is useful in the disintegration and recovery of carbide and binder metal components of sintered metal carbides, and is thus useful in the recycling of scrap carbide materials.

I claim:

1. A method of disintegrating a sintered metal carbide, which comprises subjecting the sintered metal carbide to electrolysis at a suitable amperage and current in a solution of soluble alkali metal hydroxide using as the anode in the solution the sintered metal carbide, said metal carbide consisting essentially of a metal cemented together by a metal consisting essentially of cobalt, iron, nickel or alloy thereof and alkali metal hydroxide being present in an amount sufficient to form an electrolyte and retard the formation of oxides whereby the sintered metal carbide is disintegrated to metal carbide particles which precipitate from solution.

2. The method of claim 1 wherein the sintered metal carbide is a cemented carbide, comprising a metal carbide in a matrix of a binding metal, and wherein the binding metal is dissolved in the solution.

3. The method of claim 1 wherein the alkali metal hydroxide is selected from the group consisting of sodium hydroxide, potassium hydroxide and lithium hydroxide.

4. The method of claim 1 wherein the alkali metal hydroxide is sodium hydroxide.

* * * * *